US008376692B2

(12) United States Patent
Stiehler

(10) Patent No.: US 8,376,692 B2
(45) Date of Patent: Feb. 19, 2013

(54) TURBO COMPRESSOR IN AN AXIAL TYPE OF CONSTRUCTION

(75) Inventor: Frank Stiehler, Bad Liebenwerda (DE)

(73) Assignee: MTU Aero Engines GmbH, Munich (DE)

( * ) Notice: Subject to any disclaimer, the term of this patent is extended or adjusted under 35 U.S.C. 154(b) by 744 days.

(21) Appl. No.: 12/301,901

(22) PCT Filed: May 18, 2007

(86) PCT No.: PCT/DE2007/000916

§ 371 (c)(1),
(2), (4) Date: Nov. 21, 2008

(87) PCT Pub. No.: WO2007/134585

PCT Pub. Date: Nov. 29, 2007

(65) Prior Publication Data

US 2010/0232952 A1 Sep. 16, 2010

(30) Foreign Application Priority Data

May 23, 2006 (DE) ..... 10 2006 024 085

(51) Int. Cl.
*F01D 17/16* (2006.01)

(52) U.S. Cl. ..... 415/160; 415/174.4; 415/174.5; 415/209.3; 415/230

(58) Field of Classification Search ..... 415/148–166, 415/168.1, 170.1, 173.3–173.7, 174.2–174.5, 415/182.1, 208.1–210.1, 213.1, 229–230; 29/450

See application file for complete search history.

(56) References Cited

U.S. PATENT DOCUMENTS

| | | | | |
|---|---|---|---|---|
| 4,514,141 | A * | 4/1985 | Marey | 415/160 |
| RE32,042 | E * | 12/1985 | Sheilds et al. | 29/889.22 |
| 4,604,030 | A * | 8/1986 | Naudet | 415/126 |
| 4,706,354 | A * | 11/1987 | Naudet et al. | 29/889.22 |
| 5,211,537 | A | 5/1993 | Langston et al. | |
| 5,277,544 | A * | 1/1994 | Naudet | 415/160 |
| 5,421,703 | A | 6/1995 | Payling | |
| 5,636,968 | A * | 6/1997 | Audet et al. | 415/160 |
| 6,042,334 | A * | 3/2000 | Schilling | 415/173.7 |
| 6,129,512 | A * | 10/2000 | Agram et al. | 415/160 |
| 6,481,960 | B2 * | 11/2002 | Bowen | 415/160 |
| 6,887,035 | B2 * | 5/2005 | Bruce | 415/160 |
| 7,360,990 | B2 * | 4/2008 | Barbe et al. | 415/160 |
| 2005/0232756 | A1 * | 10/2005 | Cormier et al. | 415/160 |

FOREIGN PATENT DOCUMENTS

| | | |
|---|---|---|
| EP | 1 013 885 A2 | 6/2000 |
| EP | 1 319 844 A1 | 6/2003 |
| FR | 2 775 731 | 9/1999 |

* cited by examiner

*Primary Examiner* — Fernando L Toledo
*Assistant Examiner* — Victoria K Hall
(74) *Attorney, Agent, or Firm* — Crowell & Moring LLP

(57) ABSTRACT

A turbo compressor in an axial type of construction is disclosed. The turbo compressor has a bladed stator and a bladed rotor, and has a longitudinally split compressor casing and a guide blade ring with adjustable guide blades. The guide blades are pivotably mounted about radial axes radially within their aerofoil on an inner ring belonging to the stator. The inner ring is split, i.e., segmented, at at least two points of its circumference. Furthermore, the inner ring has for each guide blade at least one bearing bush which can be inserted radially into an opening from inside.

14 Claims, 3 Drawing Sheets

TURBO COMPRESSOR IN AN AXIAL TYPE OF CONSTRUCTION

BACKGROUND AND SUMMARY OF THE INVENTION

This application claims the priority of International Application No. PCT/DE2007/000916, filed May 18, 2007, and German Patent Document No. 10 2006 024 085.5, filed May 23, 2006, the disclosures of which are expressly incorporated by reference herein.

The invention relates to a turbo compressor in an axial type of construction for a gas turbine, having a bladed stator and a bladed rotor, wherein the stator is comprised of a compressor casing that is longitudinally split on diametrically opposed sides and at least one guide blade ring with adjustable guide blades.

In the case of turbo compressors in an axial type of construction for gas turbines, in principle a differentiation is made between two designs with respect to the casing construction. There is a longitudinally split compressor casing with two diametrically opposed, axial-running parting lines, which are able to be dismantled into two "half shells." This design is also called "split case." In addition, there is also a transversely split compressor casing, which is made up of several concentric casing rings that are lined up axially in a row. As a rule, the casing rings are screwed to one another via flanges pointing radially outwardly. Both designs have specific advantages and disadvantages and may also be combined in the case of multi-stage compressors having a considerable axial extension.

The case at hand deals with compressors or compressor modules having a longitudinally split casing, i.e., the "split case" design, which offers advantages with respect to lightweight construction and ease of assembly.

Furthermore, these should be compressors which have a minimum of a guide blade ring with adjustable guide blades. These types of compressors may be better adapted to changing operating conditions, this with a low number of stages, small construction volume and low weight. It is common to position adjustable guide blades radially outside the aerofoil on or in the compressor casing, radially within the aerofoil on or in an inner ring belonging to the stator. For this purpose, the guide blades emanating from the aerofoil have an outer peg that is longer as a rule along with an inner peg that is shorter as a rule. On the aerofoil/peg transition, there is often a plate-like disk which has flow-related and mechanical functions. The static inner ring, whose radially outer surface forms a portion of the inner ring space delimitation, features for every guide blade a complementary indentation for the inner, plate-like disk on the guide blade as well as a bearing for the inner peg. As a rule, the bearing is designed as a sliding bearing with a radially oriented longitudinal center axis. The inner ring is transversely split, wherein the parting line runs through the longitudinal center of the bearing. In addition, the inner ring is longitudinally split on two diametrically opposed sides so that for all intents and purposes it is comprised of four half rings, two of which respectively abut axially and are normally screwed together. Thus, it is possible to install the guide blades in the separate compressor casing halves and then mount the inner ring with the bearing for the inner pegs. In this case, for every compressor casing half, two half rings of the inner ring axially are moved against one another over the freestanding inner pegs and the plate-like disks of the guide blades until they touch in the target position and are then screwed together. In this connection, the inner ring parts themselves are often already provided with a rub coating or run-in coating, which cooperates with circumferential fins (fins) so that it seals on the rotor (inner airseal). There are disadvantages to this inner ring construction in accordance with the prior art. The mechanical stability and the end precision are not optimal because of the transverse split and screw connection. The radial and axial dimensions are larger as a rule in relation to a monolithic component, which has implications for the rotor dimensioning. The local rotor diameter must be reduced, and in addition the rotor length increases under some circumstances. Both have disadvantages for the dynamic rotor behavior (rigidity, oscillation behavior, weight, etc.) The parts of the screw connection are able to detach during operation and produce serious damage. Because of the transverse split, the parting line impacts the position and extension of the run-in coating, because the line extends over the entire circumference of the inner ring. Due to its complexity, this design is also very expensive.

On the other hand, the objective of the invention, in the case of a turbo compressor of the type cited at the outset with adjustable guide blades, is optimizing the inner ring, which is positioned in the area of the inner airseal and the rotor, and supports the guide blades in this area, with respect to its mechanical properties, its construction volume, its weight and its ease of assembly in order to ultimately also improve rotor dynamics.

In adapting to the longitudinally split compressor casing, the inner ring is also split, i.e., segmented, at at least two points of its circumference. Each of its at least two segments is one-piece, i.e., monolithic. The inner ring has in its segments for each of the adjustable guide blades at least one bearing bush which may be inserted radially into an opening from inside. Starting from a state in which the adjustable guide blades are already inserted in the dismantled compressor casing halves, and the aerofoils' inner pegs serving as the inner bearing freely project inwardly, the segments may still be moved without bearing bushes radially from inside with their openings for the bearing bushes beginning on one segment end over the inner pegs. Through progressive feed-in, more and more openings move over the inner pegs until all inner pegs are sitting in the openings of the segment assigned to them. This mounting procedure utilizes the fact that the openings in the segments are considerably larger in terms of the diameter than the inner pegs so that the latter may be positioned temporarily eccentrically and diagonally in the openings.

The bearing bushes may then be inserted radially from the inside into the segment situated in the target position, wherein one or more bushes may be provided per bearing, i.e., per inner peg and opening. The as such monolithic segments are optimal in terms of strength, construction space and weight and do not require any additional elements such as screws, nuts, pins, etc., which are detachable. As expendable parts, the bearing bushes may be replaced without the segments of the inner ring or the guide blades having to be disassembled.

A sealing support with a rub coating or run-in coating should preferably be detachably fastened on the inner ring. The sealing support, like the inner ring itself, should be segmented and be held on the inner ring in a radially form-fit manner as a sheet metal profile.

BRIEF DESCRIPTION OF THE DRAWINGS

The invention will be explained in greater detail in the following on the basis of the drawings. The drawings show the following in simplified representation.

DETAILED DESCRIPTION OF THE DRAWINGS

Figure 1:
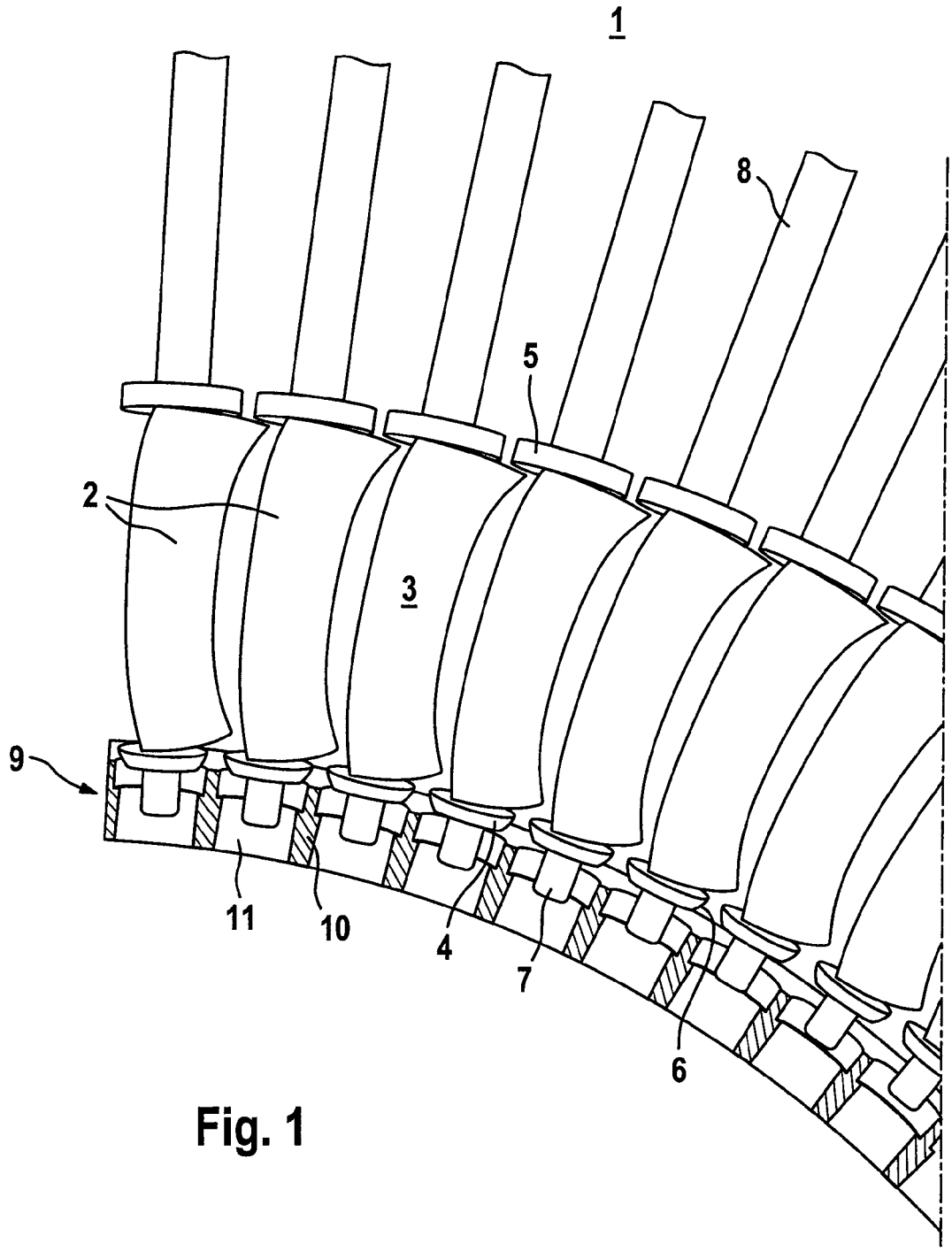
FIG. 1 is a portion of a guide blade ring with adjustable guide blades.

FIG. 1 depicts a portion of a guide blade ring 1 with adjustable guide blades 2. These types of guide blade rings are preferably used in turbo compressors in order to be able to change or adapt their flow mechanical properties. For the sake of better clarity, the compressor casing including blade bearing and the adjusting mechanism are not depicted. It is possible to see that each guide blade 2 has an aerofoil 3 that is effective in terms of flow, a radially inner and a radially outer plate-like disk 4, 5, respectively, as well as a radially inward inner peg 7 and a radially outward outer peg 8. The latter is used for positioning in or on the compressor casing and for connecting with the adjusting mechanism. In the region of the inner peg 7, it is possible to see the inner ring 9 belonging to the stator, which is comprised as a rule of two segments abutting in the circumferential direction. The inner ring 9 or its segment 10 is shown in section so that it is possible to see the openings 11 for the bearing bushes. The openings 11 may be manufactured for example by boring, counter-boring or turning. What is important is that they enable subsequent mounting of the bearing bushes radially from the inside. The monolithic segments 10 may be pre-tensioned for mounting on a defined smaller radius and be moved radially from the inside (from below in FIG. 1) over the inner pegs 7. Although in this case the inner pegs 7 and the openings 11 for the most part only approximately align, this type of mounting is possible due to the diameter difference between the inner pegs 7 and the openings 11. In order to facilitate mounting, the disks 4 dipping into the inner ring 9 feature a, e.g., conical or spherical taper 6.

FIG. 1 indicates that the segment 10 is not moved synchronously over all inner pegs 7, but begins at one point on the circumference (in this case the left) and then progresses over the circumference (in this case toward the right). In this case, the radius of the segment 10 may be increased continuously by a gradual reduction of the pre-tensioning or by a stepped reduction incrementally to the relaxed state. Ultimately, the inner pegs 7 and openings 11 are supposed to be positioned aligned in the target position. Reference is made to the fact that the described mounting procedure may be additionally facilitated in that the casing-side positioning of the outer pegs is not completed until afterwards through the insertion of the bearing bushes analogous to the positioning on the inner ring 9. As the case may be, in this case a pre-tensioning of the segment may be completely dispensed with, i.e., feed-in takes place without deformation.

Figure 2:
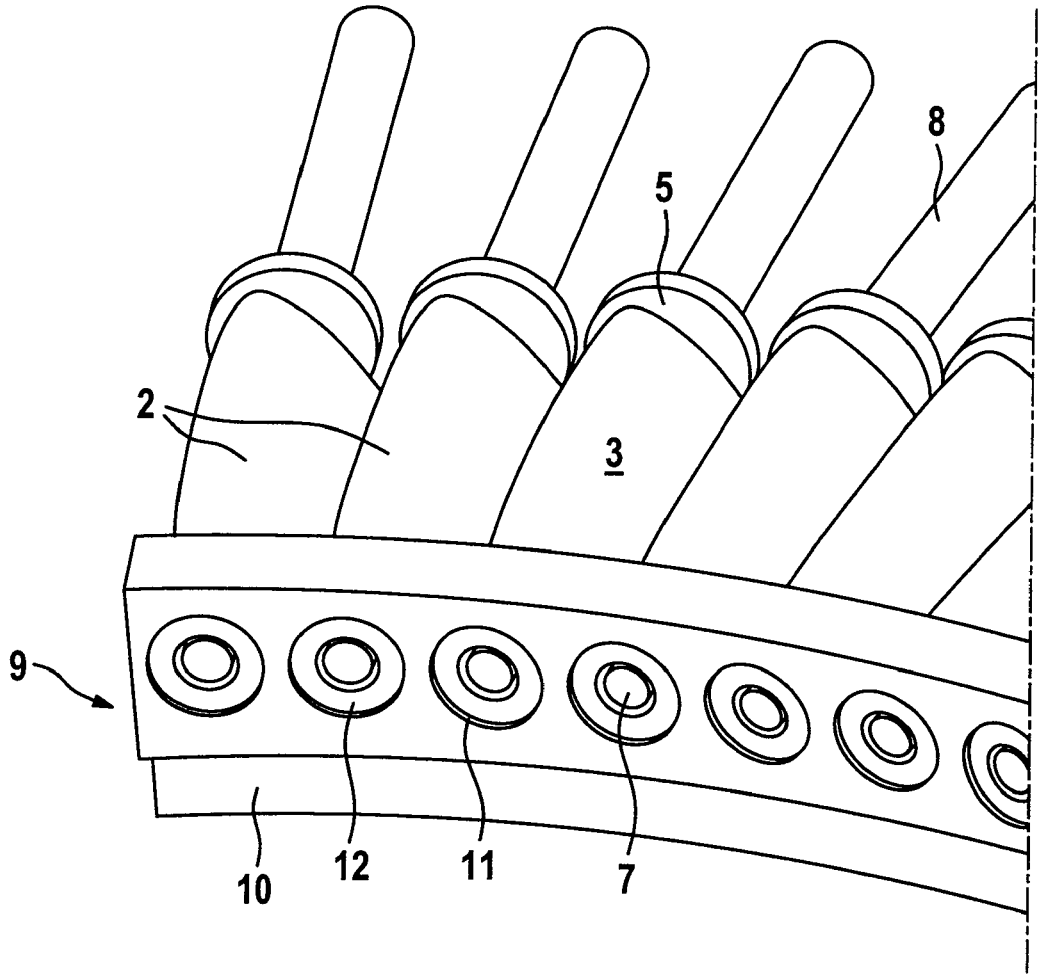
FIG. 2 is a perspective partial view of the guide blade ring after mounting of the inner ring including the bearing bushes.

FIG. 2 shows the state with the inner ring 9 or segment 10 situated in the target position, wherein the bearing bushes 12 are inserted into the openings 11 and surround the inner pegs 7 with a defined, small amount of bearing play.

Figure 3:
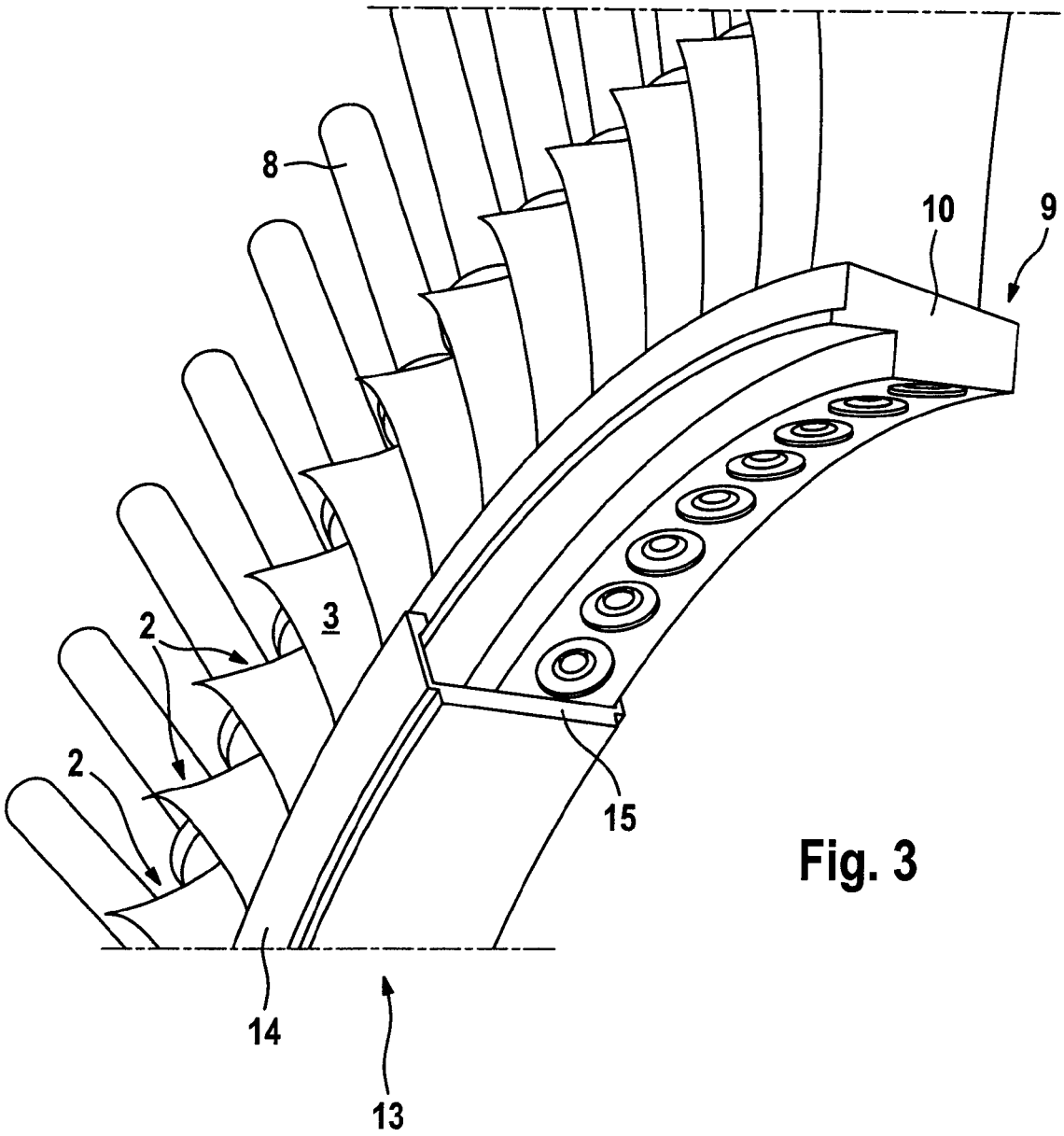
FIG. 3 is a perspective partial view of the guide blade ring during mounting of the sealing support.

FIG. 3 shows the subsequent mounting of the sealing support 13. This is how the inner ring 9 is designed to be segmented and complementary to the segment 10 is segment 14 in the form of a radially form-fit sheet metal profile. The segment 14 carries a run-in coating 15, e.g., in the form of a honeycomb seal. For mounting, the segment 14 is moved in the circumferential direction over the segment 10 until both segments overlap, i.e., are in the same angular position. Securing against rotation may take place, e.g., through plastic deformation of bending elements on the end-side. During operation, the sealing support 13 prevents the bearing bushes 12 from detaching and falling out. In the case of wear to the bearing bushes 12, first the sealing support 13, i.e., the segment 14, is disassembled. The bearing bushes may then be replaced without having to dismantle the inner ring 9.

If no sealing support 13 is required or present, the bearing bushes 12 may also be secured against detaching and falling out by other securing elements made of sheet metal or wire.

The invention claimed is:

1. A turbo compressor in an axial type of construction for a gas turbine, comprising a bladed stator and a bladed rotor, wherein the bladed stator includes a compressor casing that is longitudinally split on diametrically opposed sides and at least one guide blade ring with adjustable guide blades, wherein the adjustable guide blades are pivotably mounted about a respective radial axis on an inner ring of the bladed stator, and wherein the inner ring includes at least two segments around its circumference and includes for each adjustable guide blade a bearing bush which is insertable radially into an opening defined by the inner ring from a radial inside direction with respect to the inner ring and further comprising a sealing support with a rub coating or run-in coating detachably fastened on the inner ring, wherein the sealing support secures the bearing bush from falling out of the opening.

2. The turbo compressor according to claim 1, wherein each segment of the inner ring is deformable by bending from a first radius in an unstressed state to a second defined smaller radius.

3. The turbo compressor according to claim 1, wherein the inner ring is bisected into two segments extending respectively over an angle of approx. 180°.

4. The turbo compressor according to claim 1, wherein the sealing support includes at least two segments around its circumference and is held on the segments of the inner ring by radial form closure.

5. The turbo compressor according to claim 4, wherein the sealing support is bisected into two segments and wherein each of the two segments of the sealing support is comprised of a radially form-fit sheet metal profile that is complementary to the inner ring and includes a honeycomb structure as the rub coating or run-in coating.

6. The turbo compressor according to claim 1, wherein the compressor casing, for each adjustable guide blade, has at least one bearing bush that is insertable radially from a radial outside direction with respect to the casing into an opening defined by the casing.

7. The turbo compressor according to claim 6, wherein the openings for the bearing bushes in the inner ring and/or the openings for the bearing bushes in the casing are bore holes, counter-bores and/or cut-outs.

8. The turbo compressor according to claim 1, wherein each adjustable guide blade has a plate-like disk on a radially inner end and on a radially outer end of an aerofoil of the guide blade, and wherein at least the plate-like disk on the radially inner end has a conical or spherical taper towards the bearing bush.

9. The turbo compressor according to claim 1, wherein each of the segments of the inner ring is a monolithic structure.

10. The turbo compressor according to claim 1, wherein each of the segments of the inner ring is a monolithic structure along an entire axial length of the inner ring.

11. The turbo compressor according to claim 10, wherein each of the segments of the inner ring extends 180° or less around a circumference of the inner ring.

12. The turbo compressor according to claim 10, wherein the openings are defined by the monolithic structure.

13. The turbo compressor according to claim 12, wherein the openings are included on a radially inner side of the segments of the inner ring.

14. The turbo compressor according to claim 1, wherein the sealing support directly engages with the bearing bush.

* * * * *